US005452490A

United States Patent [19]

Brundula et al.

[11] Patent Number: 5,452,490

[45] Date of Patent: Sep. 26, 1995

[54] BRUSHROLL WITH DUAL ROW OF BRISTLES

[75] Inventors: Rudolph F. Brundula, Gates Mills; David M. Wert, Sagamore Hills, both of Ohio

[73] Assignee: Royal Appliance Mfg. Co., Cleveland, Ohio

[21] Appl. No.: 369,878

[22] Filed: Jan. 6, 1995

Related U.S. Application Data

[63] Continuation of Ser. No. 87,201, Jul. 2, 1993, abandoned.

[51] Int. Cl.[6] ..... A46B 13/02

[52] U.S. Cl. ..... 15/182; 15/179; 15/207.2; 15/366; 15/383; 15/DIG. 5; 15/DIG. 6

[58] Field of Search ..... 15/41.1, 179, 181–183, 15/366, 383, DIG. 5, DIG. 6, 207.2

[56] References Cited

U.S. PATENT DOCUMENTS

| | | | |
|---|---|---|---|
| 1,043,533 | 11/1912 | Nolan et al. | 15/DIG. 6 |
| 1,565,261 | 12/1925 | Cutler | 15/179 |
| 1,884,013 | 10/1932 | Losey | 15/383 |
| 1,886,129 | 11/1932 | Smellie . | |
| 2,045,270 | 6/1936 | Hoover . | |
| 2,260,235 | 10/1941 | Smellie . | |
| 2,659,921 | 11/1953 | Osborn | 15/182 |
| 2,754,531 | 7/1956 | Rowland | 15/183 |
| 2,879,534 | 3/1959 | Swanson et al. | 15/179 |
| 2,978,726 | 4/1961 | Park | 15/DIG. 5 |
| 3,167,802 | 2/1965 | Pratt et al. . | |
| 3,186,019 | 6/1965 | Hattori | 15/179 |
| 3,761,986 | 10/1973 | Rickel | 15/183 |
| 3,820,186 | 6/1974 | Peabody | 15/182 |
| 4,177,536 | 12/1979 | Powers | 15/182 |
| 4,357,727 | 11/1982 | McDowell | 15/41.1 |
| 4,372,004 | 2/1983 | Vermillion | 15/182 |
| 4,498,214 | 2/1985 | Oxel | 15/320 |
| 4,530,128 | 7/1985 | Jacob et al. | 15/366 |
| 4,955,102 | 9/1990 | Cousins | 15/182 |
| 5,193,243 | 3/1993 | Stegens | 15/179 |

FOREIGN PATENT DOCUMENTS

| | | | |
|---|---|---|---|
| 217513 | 12/1967 | Sweden | 15/179 |
| 13322 | of 1894 | United Kingdom | 15/179 |
| 1321081 | 6/1973 | United Kingdom | 15/DIG. 5 |

*Primary Examiner*—Mark Spisich
*Attorney, Agent, or Firm*—Fay, Sharpe, Beall, Fagan, Minnich & McKee

[57] ABSTRACT

A brushroll for a vacuum cleaner includes a cylindrical dowel having a number of holes drilled thereinto. The holes are formed into a first row and a second row, the two rows being closely spaced in relation to each other. First tufts are secured in each hole of the first row and second tufts are secured in each hole of the second row. The tufts can be made of the same type of bristle or of different types of bristles. The tufts of the first row are supported by the tufts of the second row during a cleaning rotation of the brushroll. Preferably, the tufts of the second row are located at between ¼ and ¾ of a free length of the first row of tufts. The bristles of the second row are shorter than the bristles of the first row. If desired, a third row of tufts may also be provided. The rows of tufts can extend helically around the dowel.

20 Claims, 3 Drawing Sheets

BRUSHROLL WITH DUAL ROW OF BRISTLES

This is a file-wrapper continuation of application Ser. No. 08/087,201 now abandoned filed on Jul. 2, 1993.

The invention relates generally to brushrolls. More specifically, the present invention relates to a brushroll arrangement for floor care appliances.

The invention is particularly applicable to brushrolls for vacuum cleaners. However, it will be appreciated by those skilled in the art that the invention has broader applications and may also be adapted for use in many other environments where a brushroll is utilized.

It is known to use agitator rolls or brushrolls having both bristle strips and beater bars in a vacuum cleaner environment because the rows of bristles and the beater bar structure combine to aid in the pickup of dirt from the rug. Brushrolls are even known where the brush strip or bristle strip is located closely adjacent a beater bar. Thus, the beater bar reinforces the brush strip during its cleaning operation. More specifically, the brush strip is bent backwardly over the beater bar and imparts a flicking action to the rug on which it is being utilized. It is further known to bias a bristle strip in a forward direction through the use of an integral hinge for a beater bar which is located next to and contacts the brush strip. However, in all such conventional brushroll constructions, a groove needs to be formed in the dowel of the brushroll and a bristle strip molded of plastic or rubber with either an integral beater bar or a beater bar that is glued thereto needs to be slid into the groove provided on the dowel. Obviously, it is more expensive to manufacture both a grooved dowel and a bristle strip and beater bar combination and then slide the latter into the groove of the former. In addition, it is even more expensive to groove a dowel with two reverse helixes and then secure thereto such a bristle strip beater bar combination in the case of a brushroll which is meant to cooperate with a centrally located inlet of a nozzle base of a vacuum cleaner. In order to provide reverse helixes, two separate bristle strips will need to be utilized and two oppositely extending helical grooves will need to be provided along the length of the dowel.

Accordingly, it has been considered desirable to develop a new and improved brushroll which would overcome the foregoing difficulties and others while providing better and more advantageous overall results.

BRIEF SUMMARY OF THE INVENTION

The instant invention relates to a new and improved brushroll.

More particularly in accordance with this aspect of the invention, the brushroll comprises a cylindrical dowel having a plurality of holes drilled thereinto. The holes are formed in a first row and a second row, the rows being spaced from each other. A first tuft is secured in each hole of the first row. A second tuft is secured in each hole in the second row. The tufts of the first row are supported by the tufts of the second row during a cleaning rotation of the brushroll.

If desired, the second tufts can be shorter than the first tufts and may be approximately two-thirds the length thereof. The first and second tufts are made of bristles that can comprise fibers of substantially identical stiffness. The fibers can also have substantially the same diameter. Preferably, the first and second rows are arranged helically on the dowel. If desired, the first and second rows can have respective sections which are formed as reverse helixes. If desired, a third row of holes can be spaced from the first and second rows of holes and a tuft of a third type of bristle can be secured in each hole of the third row.

In accordance with another aspect of the invention, a brushroll or agitator is provided for a vacuum cleaner.

More particularly in accordance with this aspect of the invention, the brushroll comprises a cylindrical dowel. A first helically extending row of holes is located in the dowel and a second helically extending row of holes is located in the dowel closely adjacent the first row. A first bristle tuft is secured in each hole of the first row and a second bristle tuft is secured in each hole of the second row. The bristle tufts of the second row are located at between ¼ and ¾ of a free length of the bristle tufts of the first row so that the bristle tufts of the first row are supported by the bristle tufts of the second row during a cleaning rotation of the brushroll.

If desired, the second bristle tufts can be shorter than the first bristle tufts. The first and second bristle tufts can comprise fibers of substantially identical stiffness and substantially identical diameter. The fibers can be either level or crimped. If desired, the first and second rows can comprise respective sections formed as reverse helixes. Also, if desired, a third row of holes can be provided spaced from the first and second rows of holes. A third bristle tuft can be secured in each hole of the third row.

One advantage of the present invention is the provision of a new and improved brushroll which is inexpensive to manufacture.

Another advantage of the present invention is the provision of a brushroll having enhanced cleaning effectiveness when used in a floor care appliance.

Still another advantage of the present invention is the provision of a brushroll which utilizes a pair of aligned closely spaced rows of tufts such that the second row of tufts supports the first row of tufts during a cleaning rotation of the brushroll. In relation to the known brushrolls which utilize a beater bar to back up a row of tufts, the instant design which employs a second closely spaced adjacent row of tufts is advantageous in that it allows a much less expensive brushroll to be manufactured. This construction eliminates the need to form grooves in the dowel and then slide a combination bristle strip and backup beater bar, which had to be separately formed, into such grooves.

Yet another advantage of the present invention is the provision of a brushroll that has a pair of closely spaced helically extending rows of tufts that have respective sections formed as reverse helixes in order to accommodate a suction air inlet of a nozzle base located near the middle of the brushroll. Especially with the reversing helix type brushroll, it would be prohibitively expensive to manufacture a dowel with reversing helical grooves and separately manufacture combination bristle strip/backup beater bars which needed to be slid into the reversing helixes of the dowel.

A further advantage of the present invention is the provision of a brushroll with a pair of closely spaced rows of tufts wherein the second row of tufts is shorter than the first row of tufts. If desired, the rows of tufts can be made of bristle fibers of substantially identical stiffness and substantially identical diameter. The bristle fibers can be made of the same material or different materials as desired. Also, the fibers can be either level or crimped as desired.

A still further advantage of the present invention is the provision of a brushroll with three closely spaced rows of tufts. The second row of tufts can be shorter than the first and third rows if desired. Such tufts can comprise bristles made of the same or of different materials and can have bristle fibers of substantially identical stiffness, diameter and geometry or of different stiffnesses, diameters and geometries as desired.

Still other advantages and benefits of the invention will become more readily apparent to those skilled in the art upon a reading and understanding of the following detailed specification.

BRIEF DESCRIPTION OF THE DRAWINGS

The invention may take physical form in certain parts and arrangements of parts several embodiments of which will be described in detail in this specification and illustrated in the accompanying drawings which form a part hereof and wherein.

DETAILED DESCRIPTION OF THE EMBODIMENTS

Figure 1:
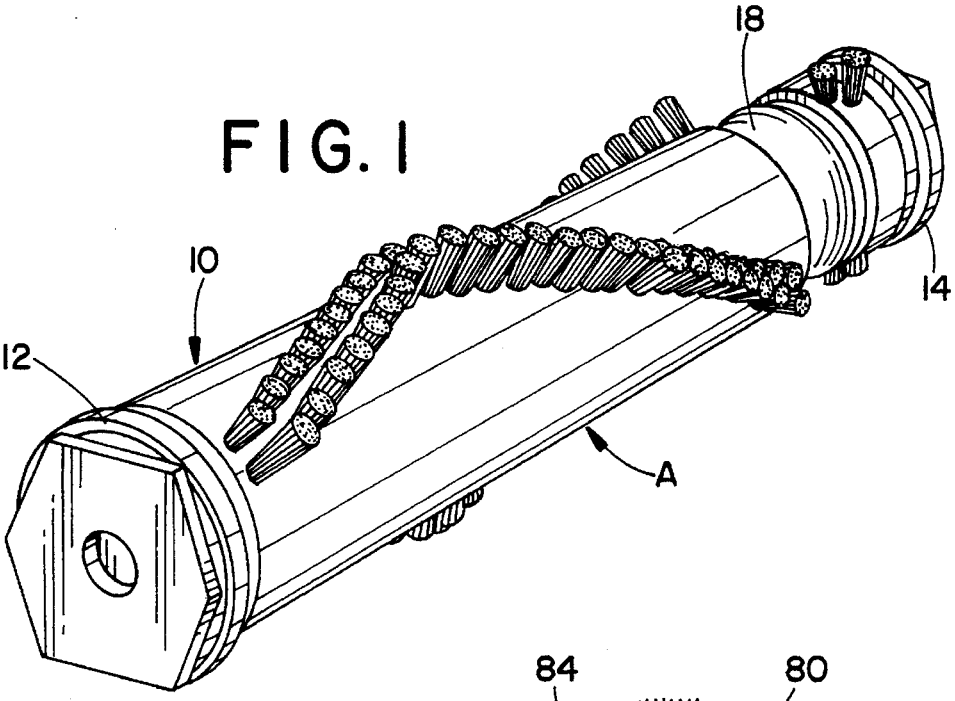
FIG. 1 is a perspective view of a brushroll according to the present invention.

Referring now to the drawings, wherein the showings are for purposes of illustrating several embodiments of the invention only and not for purposes of limiting same, FIG. 1 shows a brushroll A in accordance with the present invention. The brushroll comprises a dowel 10 having a first end 12 and a second end 14 as well as an outer periphery 16. A crown portion 18 is located on the outer periphery 16 for cooperating with a suitable known belt (not illustrated) which is also looped around a suitable conventional motor (not illustrated) in order to rotate the brushroll A.

Figure 5:
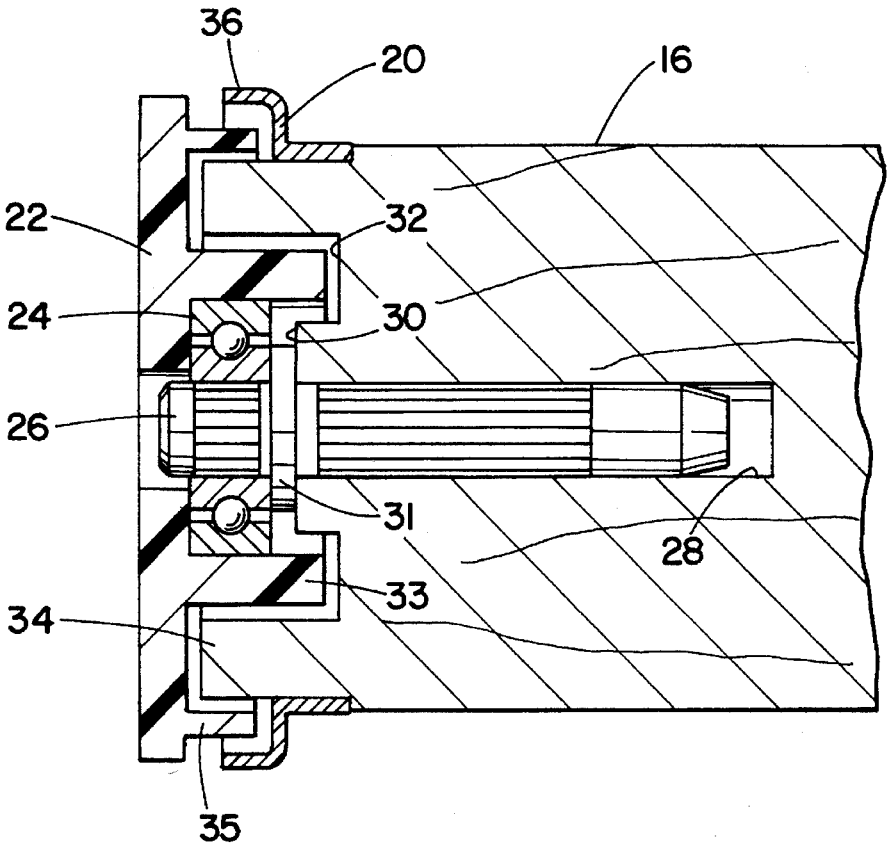
FIG. 5 is a cross-sectional view of an end portion of the brushroll of FIG. 1.

With reference now also to FIG. 5, located on each end of the brushroll dowel 10 is a suitable end assembly. Since both end assemblies are identical, only the left end assembly will be described herein, it being appreciated that both end assemblies contain an identical structure. Secured to the dowel outer periphery 16 at a reduced diameter end portion thereof, is a thread guard 20. The thread guard, which is in the form of a stepped ring, cooperates with an end cap 22 that is mounted on a bearing 24. The bearing, in turn, is mounted on a pin 26 which protrudes into a hole 28 extending into the end face of the dowel 16. The end face of the dowel is also provided with a central plateau 30 on which rests a shoulder 31 of the pin 26 and with an annular groove 32 positioned radially outwardly thereof. An inner skirt 33 of the end cap 22 extends within the groove 32.

Located radially outwardly of the groove 32 is an annular rib 34 defined in the dowel end face. An annular outer second skirt 35, which is located radially outwardly of the inner skirt 33, is located on the end cap 22 adjacent its outer periphery and in an encircling relationship to the first skirt 32. A shoulder 36 of the thread guard 20, outer skirt 35, rib 34 and inner skirt 33 cooperate to form a labyrinth seal on the end of the dowel 10. This prevents threads or the like from working their way along the end face of the dowel so as to become trapped adjacent the bearing 24 and interfere with the rotation of the dowel on the bearing. It is noted in this regard that the thread guard 20 forms a shoulder that faces away from the center of the dowel 10 in order to prevent threads or the like from working their way to the end of the dowel and becoming trapped between the shoulder 36 and the outer skirt 35 of the end cap 22.

Figure 4:
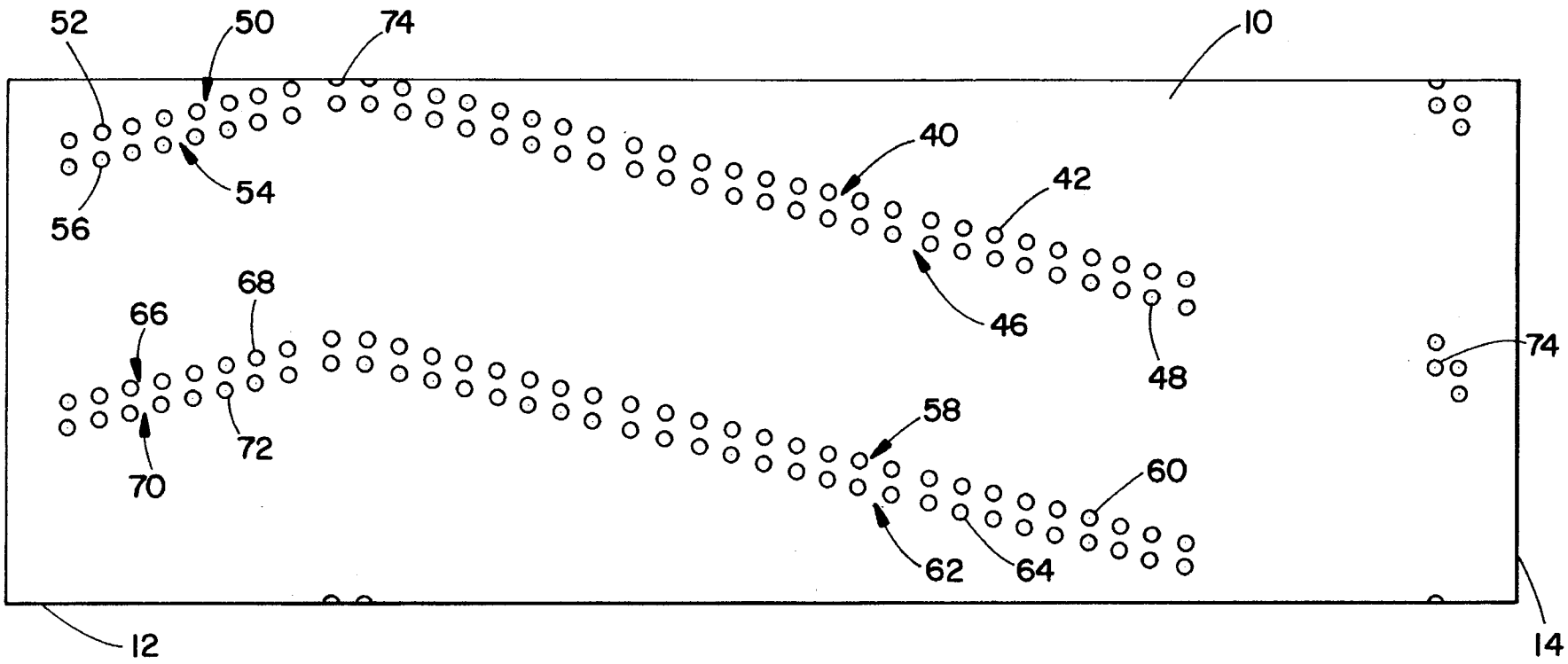
FIG. 4 is a developed view of the brushroll of FIG. 1.

With reference now to FIG. 4, the dowel 10 is provided with a plurality of rows of holes. More specifically, a first row 40 comprising a series of aligned holes 42 extends along a portion of the length of the dowel 10. Also provided is a second row 46 which is located closely adjacent the first row 40. The second row similarly comprises a plurality of aligned holes 48. It is evident that while the first and second rows of holes 40 and 46 extend along a major portion of the dowel 10, they intersect a third row 50 having a plurality of holes 52 and a fourth row 54 similarly comprising a plurality of holes 56.

As is further evident from the developed view of FIG. 4, a fifth row 58 comprising a plurality of holes 60 is spaced from the first row 40 and a sixth row 62 similarly comprising a plurality of holes 64 is spaced from the fifth row. In the same manner, a seventh row of holes 66 comprising a plurality of holes 68 and an eighth row 70 comprising a plurality of holes 72 are spaced from the third and fourth rows 50 and 54. The several sets of intersecting rows of holes, i.e., 40 and 46 and 50 and 54 cooperate to form an inlet section 74 for the dowel 10. The inlet section of the dowel is the area to which dust, dirt and the like are driven so as to be picked up by a suction opening located at that position in a conventional vacuum cleaner nozzle (not illustrated for the sake of simplicity).

It will be noted that along the second end 14, a small number of holes 74 are provided. These holes are on the far side of the crowned portion 18 of the dowel.

The dowel 10 is preferably made from a wood material. Preferably, the material for the dowel 10 can be a kiln-dried maple. It should be appreciated that any other type of wood or plastic material, or even metallic material or composite material can be utilized if desired.

Figure 2:
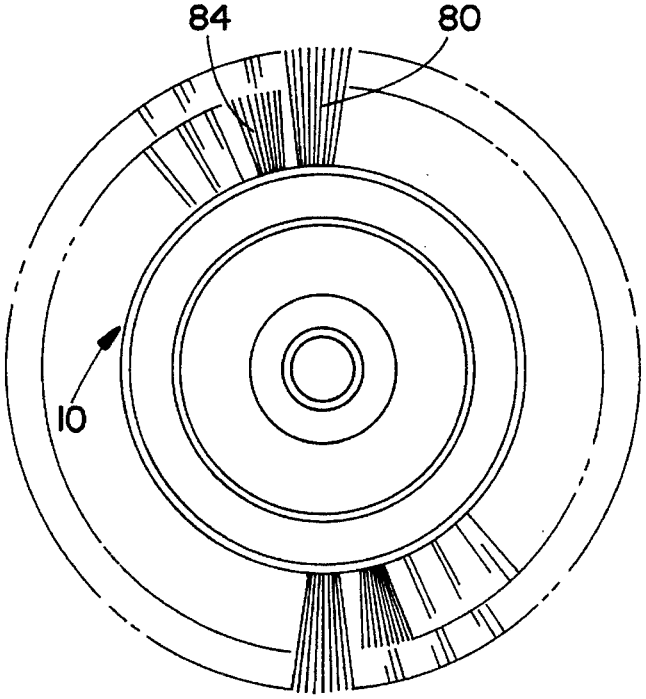
FIG. 2 is an enlarged cross-sectional view of the brushroll of FIG. 1.
Figure 3:
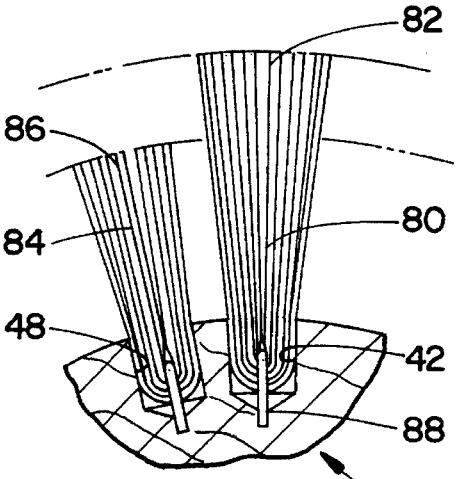
FIG. 3 is a greatly enlarged cross-sectional view of a portion of FIG. 2 illustrating two tufts of bristles.

With reference now to FIG. 3, a first tuft 80 of bristles 82 is located in the first hole 42 and a second tuft 84 of bristles 86 is located in the second hole 48. Each of these sets of bristles is secured in its respective hole by means of a suitable staple 88 which penetrates the material of the dowel. In one embodiment, as is illustrated in FIG. 3, the first tuft 80 is taller than the second tuft 84. With reference now to FIG. 2, the diameter of the dowel including the first tufts 80 and the corresponding tufts in the holes 60 in the fifth row 58 can be on the order of 2.375 inches. In contrast, the diameter of the dowel from the outer periphery of the second tuft 84 to a similar tuft being secured in the hole 64 of the sixth row 62 can be on the order of 2.094 inches. Therefore, the height difference between the two tufts 80 and 84 can be on the order of 0.1405 inches.

The several holes in each of the rows 40, 46, 58, 62 and so on can be spaced apart by approximately 0.3 inches if desired. The holes of each two rows such as, e.g. the holes 42 and 48, can be spaced apart, typically, from center to center by approximately 0.22 inches if desired. It should be evident that the hole spacing either along one row of holes or between the two rows of holes can be other than the dimensions indicated for particular environments. The depths of the holes can be on the order of approximately 0.23 inches. The diameters of each of the holes can be on the order of 5/32 inch. The holes are filled with bristles which can, e.g., be made of any suitable material either man-made or natural. One such material is nylon 66 or the like. Such bristles can have a diameter of 0.008 inches if desired. The holes are filled with as many such bristles as will fit in them.

Figure 8:
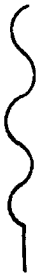
FIG. 8 illustrates a crimped fiber which can be employed in the tufts of bristles according to the present invention.

The bristle fibers can be made of either a crimped material, as illustrated in FIG. 8, or a level material. The crimped material provides a wavy appearance to the bristle fiber whereas the level material provides a flat appearance to the fiber. Some prefer the crimped material for the reason that it provides a fuller looking tuft. While the outer surface of the tufts 80 and 84 is shown as being substantially flat, it can be envisioned that the outer surfaces could be angled in a particular direction such as towards or away from the direction of rotation of the brushroll. In addition, the tuft outer surfaces can be either convex or concave as may be desired.

As is well known in the art, the diameter of the dowel can be on the order of approximately 1.5 inches. The length of the dowel can be on the order of approximately 14 inches. It should be appreciated that the length and diameter of the dowel and, therefore, the number of holes and the number of rows of holes provided thereon is entirely dependent upon the cleaning environment for which the dowel is designed. Thus it would be possible to provide, for example, three double rows of bristles spaced 120 degrees apart instead of two double rows of bristles spaced 180 degrees apart as in FIG. 4, if so desired.

Figure 7:
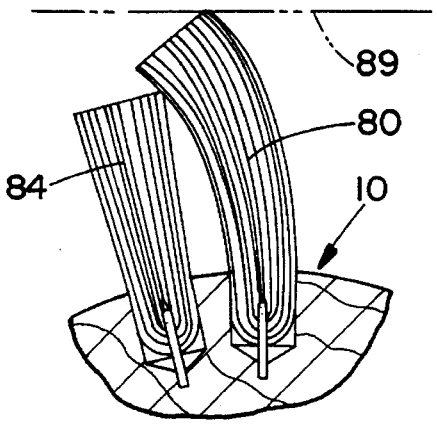

With reference now also to FIG. 7, the intent of so closely spacing the tuft 84 in relation to the tuft 80 is there illustrated. More particularly, the tuft 84 provides support for the tuft 80 as the latter encounters a surface meant to be cleaned, such as the surface 89.

In the embodiment of FIG. 3, the tufts 80 and 84 are comprised of the same type of material. More specifically, the bristles 82 and 86 have the same diameter and the same stiffness. While the bristle fibers have the same stiffness and same diameter, since the tuft 84 is shorter than the tuft 80, the tuft 84 will be relatively stiffer and thereby provide a backup to the tuft 80. It should be appreciated, however, that it would be possible to provide different types of bristles in the tufts 80 and 84 such that, e.g., the bristles 86 in the tuft 84 can have a larger diameter or be comprised of a stiffer material than the bristles of the tuft 80.

Figure 6:
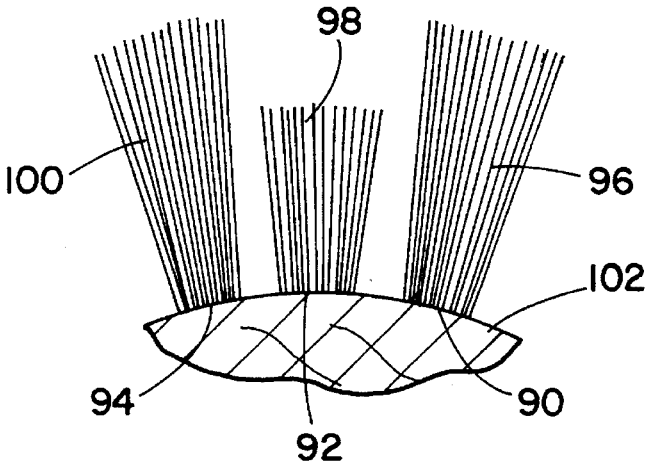
FIG. 6 is an enlarged cross-sectional view of another embodiment of the invention illustrating three closely adjacent tufts of bristles; and, FIG. 7 illustrates the tufts of FIG. 3 when the first tuft contacts a surface meant to be cleaned, is bent backwards by such surface and is supported by the second tuft.

With reference now to FIG. 6, another embodiment of a tuft construction is there illustrated. Three closely spaced rows 90, 92 and 94 of tufts are shown. Each of these rows is comprised of a plurality of bristle tufts such as tufts 96, 98 and 100.

As with the embodiment of FIG. 3, the tufts can comprise identical bristles or bristles of different materials, diameters, stiffnesses and the like. In the embodiment of FIG. 6, the second tuft 98 has bristles which are shorter than the bristles of the first and third tufts 96 and 100. In this embodiment, the second tuft 98 will support the first tuft 96 during a clockwise rotation of a dowel 102 to which the several tufts are secured. The third tuft 100 may add additional sweeping power to the brushroll to clean up any material left behind by the first and second tufts 96 and 98.

It is anticipated that the design illustrated in FIG. 6 would prove useful in connection with a wet/dry type vacuum cleaner. Such cleaners usually have a slow rpm speed used when reversing the rotation of the brushroll. The tree bristle row design of FIG. 6 would be suited for this environment.

The invention has been described with reference to several embodiments. Obviously, modifications and alterations will occur to others upon the reading and understanding of this specification. It is intended to include all such modifications and alterations insofar as they come within the scope of the appended claims or the equivalents thereof.

What is claimed is:

1. A brushroll comprising:

a cylindrical dowel having a plurality of holes drilled thereinto, said holes being formed in a first row and a second row, said rows being spaced from each other;

a first tuft secured in each hole of said first row;

a second tuft secured in each hole of said second row, wherein a distance from a center of each hole of said first row to a center of an adjacent hole of said second row is approximately one and one half times a difference in length between a free length of said first tufts and a free length of said second tufts; and, a means for supporting said tufts of said first row during a cleaning rotation of the brushroll, said means for supporting comprising said tufts of said second row.

2. The brushroll of claim 1 wherein said first and second tufts comprise bristles made of the same material.

3. The brushroll of claim 1 wherein said first and second rows of holes are helically arranged on said dowel.

4. The brushroll of claim 3 wherein said first and second rows of holes have respective sections formed as reverse helixes.

5. The brushroll of claim 1 wherein first and second tufts are comprised of bristles having the same diameter.

6. The brushroll of claim 1 further comprising:

a third row of holes spaced from said first and second rows of holes; and, a third tuft secured in each hole of said third row.

7. The brushroll of claim 1 further comprising a crown portion located on said dowel, wherein no tufts are located on said crown portion.

8. The brushroll of claim 1 further comprising a pair of thread guards, one being located on each end of said dowel.

9. The brushroll of claim 1 further comprising a labyrinth seal formed on each end of said dowel.

10. A brushroll for a vacuum cleaner, comprising:

a cylindrical dowel having a plurality of holes drilled thereinto, said holes being formed in a first row and a second row which is disposed closely adjacent said first row;

a tuft of a first type of bristle secured in each hole of said first row;

a tuft of a second type of bristle secured in each hole of said second row, wherein said tufts of said second row are spaced from respective adjacent tufts of said first row by a distance between one quarter and three quarters of a free length of said bristles of said first row of tufts; and, a means for supporting said first row of tufts during a cleaning rotation of the brushroll, said means for supporting comprising said second row of tufts, wherein during the cleaning rotation of the brushroll said first row of tufts contacts said second row of tufts and prevents said second row of tufts from contacting a surface meant to be cleaned.

11. The brushroll of claim 10 wherein said second type of bristle is shorter than said first type of bristle.

12. The brushroll of claim 11 wherein said first and second types of bristle are comprised of crimped fibers.

13. The brushroll of claim 10 wherein said first and second rows of holes are helically arranged on said dowel.

14. The brushroll of claim 13 wherein said first and second rows of holes have respective sections formed as reverse helices.

15. The brushroll of claim 10 further comprising:

a third row of holes spaced from said first and second rows of holes; and, a tuft of a third type of bristle secured in each hole of said third row.

16. A brushroll for a vacuum cleaner, comprising:

a cylindrical dowel;

a first row of holes located in said dowel;

a second row of holes located in said dowel, said rows being spaced from each other;

a tuft of a first type of bristle secured in each hole of said first row;

a tuft of a second type of bristle secured in each hole of said second row, wherein a distance from a center of each hole of said first row to a center of an adjacent hole of said second row is approximately one and one half times a difference in length between a free length of said tuft of said first type and said tuft of said second type;

a means for supporting said tufts of said first row during a cleaning rotation of the brushroll, said means for supporting comprising said tufts of said second row;

a first thread guard located on a first end of said dowel; and, a second thread guard located on a second end of said dowel.

17. The brushroll of claim 16 wherein said second type of bristle is shorter than said first type of bristle.

18. The brushroll of claim 16 wherein said first and second rows are helically arranged on said dowel.

19. The brushroll of claim 18 wherein said first and second rows have respective sections formed as reverse helices.

20. The brushroll of claim 16 further comprising:

a third row of holes spaced from said first and second rows of holes; and, a tuft of a third type of bristle secured in each hole of said third row.

* * * * *